US005829550A

United States Patent [19]

Cornish

[11] Patent Number: 5,829,550

[45] Date of Patent: Nov. 3, 1998

[54] SCAFFOLDING SYSTEM

[75] Inventor: John Robert E. Cornish, Chislehurst, England

[73] Assignee: SGB Services Plc., Horsham, England

[21] Appl. No.: 604,523

[22] Filed: Feb. 21, 1996

[30] Foreign Application Priority Data

Feb. 21, 1995 [GB] United Kingdom ..... 9503432

[51] Int. Cl.[6] ..... E04G 1/26

[52] U.S. Cl. ..... 182/113

[58] Field of Search ..... 182/113, 178, 182/179; 5/100

[56] References Cited

U.S. PATENT DOCUMENTS

| | | | |
|---|---|---|---|
| 2,882,100 | 4/1959 | Bank | 182/178 |
| 5,134,734 | 8/1992 | Bozino | 5/100 |
| 5,165,124 | 11/1992 | Li | 5/100 |

FOREIGN PATENT DOCUMENTS

| | | | |
|---|---|---|---|
| 6077 | 2/1933 | Australia | 5/100 |
| 2 336 532 | 7/1977 | France . | |
| 2 347 508 | 11/1977 | France . | |
| 6307073 | 1/1994 | Japan | 182/113 |

*Primary Examiner*—Alvin C. Chin-Shue
*Attorney, Agent, or Firm*—Arnold, White & Durkee

[57] ABSTRACT

In a frame scaffolding system a guard rail is provided. The guard rail is intended to be positioned adjacent an upper layer of the frame scaffolding, but is initially positioned adjacent a lower layer of the frame scaffolding and can be manoeuvred into position by personnel standing on the lower layer. Vertical members of the scaffolding system are provided with guiding and support assemblies, and the guard rail has elements which co-operate with the guiding and support assemblies. The guard rail is thus guided during movement between the initial lower position and the terminal upper position. Support elements are also provided to support the guard rail at at least one intermediate position between the initial position and the terminal position to facilitate the lifting procedure.

2 Claims, 10 Drawing Sheets

SCAFFOLDING SYSTEM

FIELD AND BACKGROUND OF THE INVENTION

THE PRESENT INVENTION relates to a scaffolding system, and more particularly relates to a scaffolding system of the modular or "frame" type.

A typical "frame" scaffolding system comprises a plurality of rectangular frames, each comprising two upright members interconnected, at the top, and optionally at the bottom, by horizontally extending members. Initially two frames are spaced in parallel planes, in alignment with each other, and are interconnected by further horizontal elements forming, for example, guard rails. A floor is then mounted in position extending between the frames. Subsequently, further frames can be located on top of the first pair of frames, the further frames again being provided with guard rails and flooring.

It has been appreciated that accidents can arise if a scaffolding erector, who is erecting a frame scaffold, is operating at a predetermined level before the guard rails have been provided at that level. In many cases, the flooring, for a particular level, may be supported by horizontal members provided at the top of the frames immediately beneath that level. Thus, a person may be working on that flooring, locating the frames in position, and since the guard rails usually extend between the frames, it is not possible for a guard rail to be in place before the frames have been put in place. Consequently, the scaffolding erector is very exposed, standing on flooring with no adjacent frames or guard rails, and a slip may prove to be fatal.

Similar problems arise when erecting scaffolding which is not of the "frame" type—such as modular scaffolding.

OBJECT OF THE INVENTION

The present invention seeks to provide a scaffolding arrangement in which a guard rail may be located in position adjacent a predetermined level of a frame scaffold system before the frames and flooring for that particular level have been located in position.

SUMMARY OF THE INVENTION

According to this invention there is provided a scaffolding system, the scaffolding system comprising at least a pair of vertical members, each vertical member being provided with a guiding and support assembly, the guiding and support assembly serving to guide and support a guard rail, the guard rail having elements adapted to cooperate with the guiding and support assemblies; the guiding and support assemblies being adapted to support the guard rail at least in an initial lowered position and also in an elevated terminal position; the guiding and support assemblies, and the guard rail, having means adapted to co-operate to guide the guard rail during movement between the initial position and the terminal position; the guard rail being adapted, when in the elevated terminal position, to act as a guard rail for a level of scaffolding located above the level of scaffolding adjacent the initial lowered position.

Conveniently each guiding and support assembly is provided with means adapted to support the guard rail at at least one intermediate position between the initial position and the terminal position.

Preferably each guiding and support assembly defines means defining a channel, and the guard rail is provided with an element adapted to be engaged slidably with the channel to provide said guiding as the guard rail is lifted from the first position to the terminal position.

Advantageously each guiding and support assembly is provided with means adapted to support the guard rail at two intermediate positions.

In one embodiment each guiding and support assembly is removably mounted on a frame.

Conveniently the guiding and support assemblies are each provided with means adapted to engage lugs provided on the frames to locate and support guiding and support assemblies.

In an alternative embodiment the guiding and support assemblies are formed integrally with the frames.

Preferably each guiding and support assembly comprises at least one elongate member, the member comprising means defining a channel adapted to receive and guide at least one part of the guard rail.

Conveniently the channel is provided with a catch positionable to support an element within the channel and prevent downward movement of the element.

Preferably the catch is also positionable to extend into the channel to engage the guard rail to prevent upward movement of the guard rail.

Advantageously the catch is positioned so that it is only accessible to a person standing on the said level of scaffolding adjacent the initial lowered position.

Conveniently the guard rail comprises an upper rail having projecting free ends, the channel being adapted to receive and guide one said free end.

In a preferred embodiment the guard rail additionally comprises vertical portions located beneath the free ends of the top rail, the channel being adapted to receive a said vertical portion and guide movement of the vertical portion.

Conveniently the vertical portion is provided with projecting rollers.

Advantageously each guiding and support assembly further defines a platform located in alignment with the channel but at a position beneath the channel, the platform being adapted to receive and support at least the projecting free end of the guide rail.

Preferably the platform is additionally adapted to support the lower end of the vertical portion of the guard rail.

The scaffolding system may be a modular scaffolding system, but may preferably be a frame scaffolding system, each said vertical member comprising part of a respective frame, each frame having two spaced apart vertical members and at least one cross bar, the said frames being located at spaced apart positions in parallel planes.

BRIEF DESCRIPTION OF THE DRAWINGS

In order that the invention may be more readily understood, and so that further features thereof may be appreciated, the invention will now be described, by way of example, with reference to the accompanying drawings in which.

DETAILED DESCRIPTION OF THE DRAWINGS

Figure 1:
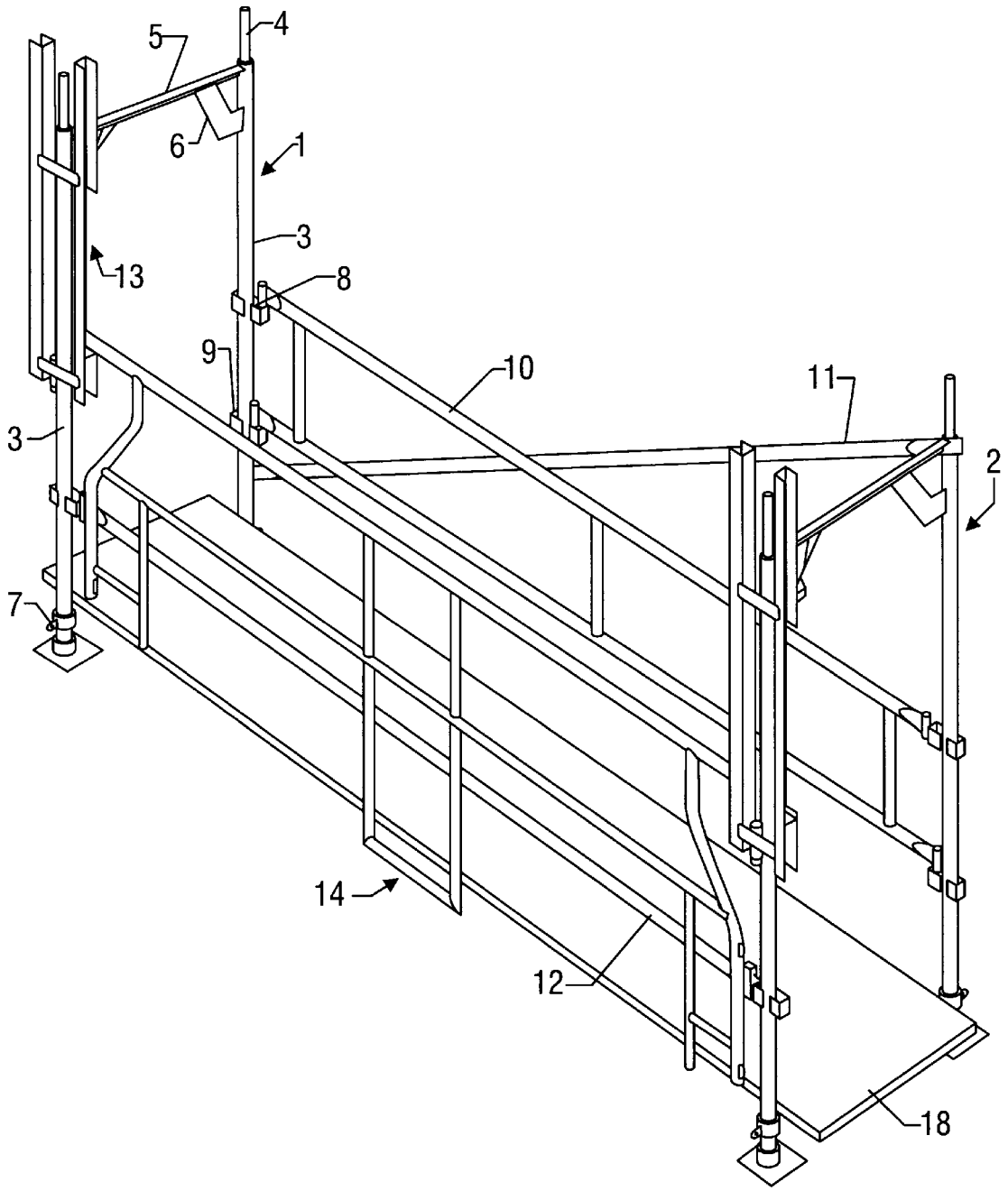
FIG. 1 is a perspective view of one bay of a frame scaffolding system in accordance with the invention, with a guard rail in an initial position.

FIG. 1 illustrates one bay of a frame scaffold system in accordance with the invention. The illustrated bay comprises two identical frames 1,2 which are spaced apart in parallel planes. Each frame comprises two upright members 3 each terminating, at their upper ends, with a spigot 4. The upright members are interconnected by a horizontal upper cross bar 5 which extends between the upright members 3 and which is connected thereto by a vertical reinforcing plate 6 extending beneath the cross bars across the corner defined between the cross bar 5 and the upright member 3. Mounting to the lower ends of the upright member 3 of each frame 1,2 is a horizontal element, the ends of which are connected to the upright members 3 by means of locking collars 7. These horizontal elements support flooring 8 which extends between the frames. The flooring may comprise a single panel or may comprise a plurality of planks.

The vertical members 3 of each frame are each provided with two pairs of lugs 8,9. The lugs of each pair of lugs are diametrically opposed. The pairs of lugs are spaced apart vertically, with the lugs of the two pairs of lugs being in alignment. A fixed guard rail 10 may be connected to the lugs 8 and 9 of the two spaced apart frames 1,2, for example on the side of the frames to be located adjacent a building. A diagonally extending reinforcing strut 11 is also provided extending between the frames 1 and 2. A single guard bar 12 extends between the two lower lugs 9 on the upright members 3 of the frames 1,2 located furthest from the wall.

As thus far described, the frame system is conventional.

Figure 5:
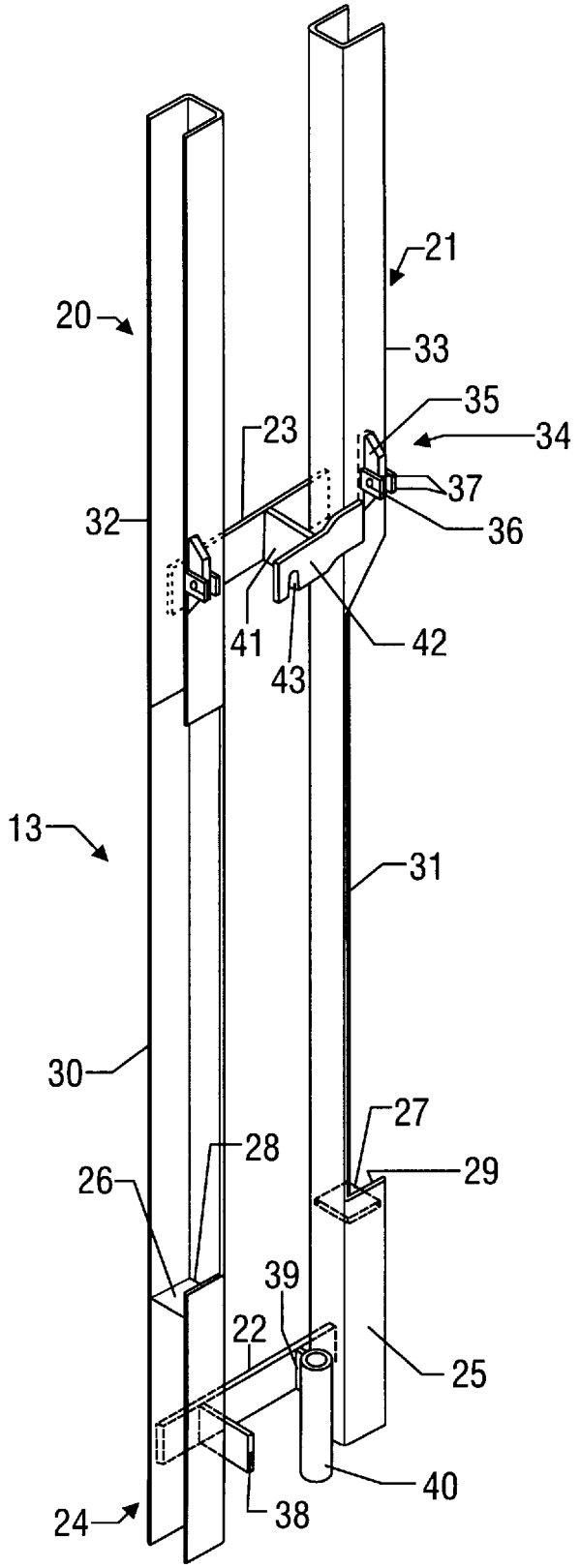
FIG. 5 is a perspective view of a support and guiding component forming part of the system as shown in FIGS. 1 to 4.

Mounted on the upright members 3 of the frames 1 and 2 which are located away from the wall are guiding and support assemblies 13 which are illustrated in more detail in FIG. 5. Mounted on the guiding and support assemblies 13 is a guard rail 14. The guard rail 14 is shown, in FIG. 1, in an initial lowered position.

The structure of the guiding and support assembly 13 and the guard rail 14 will be described in greater detail hereinafter, but, as will become clear, in operation of the system the guard rail 14 may initially be moved from the initial position illustrated in FIG. 1, to an elevated position shown in FIG. 2. The distance that the guard rail 14 is lifted is not very great, being about 1 meter, meaning that a single person may lift the guard rail 14 through that distance.

Figure 3:
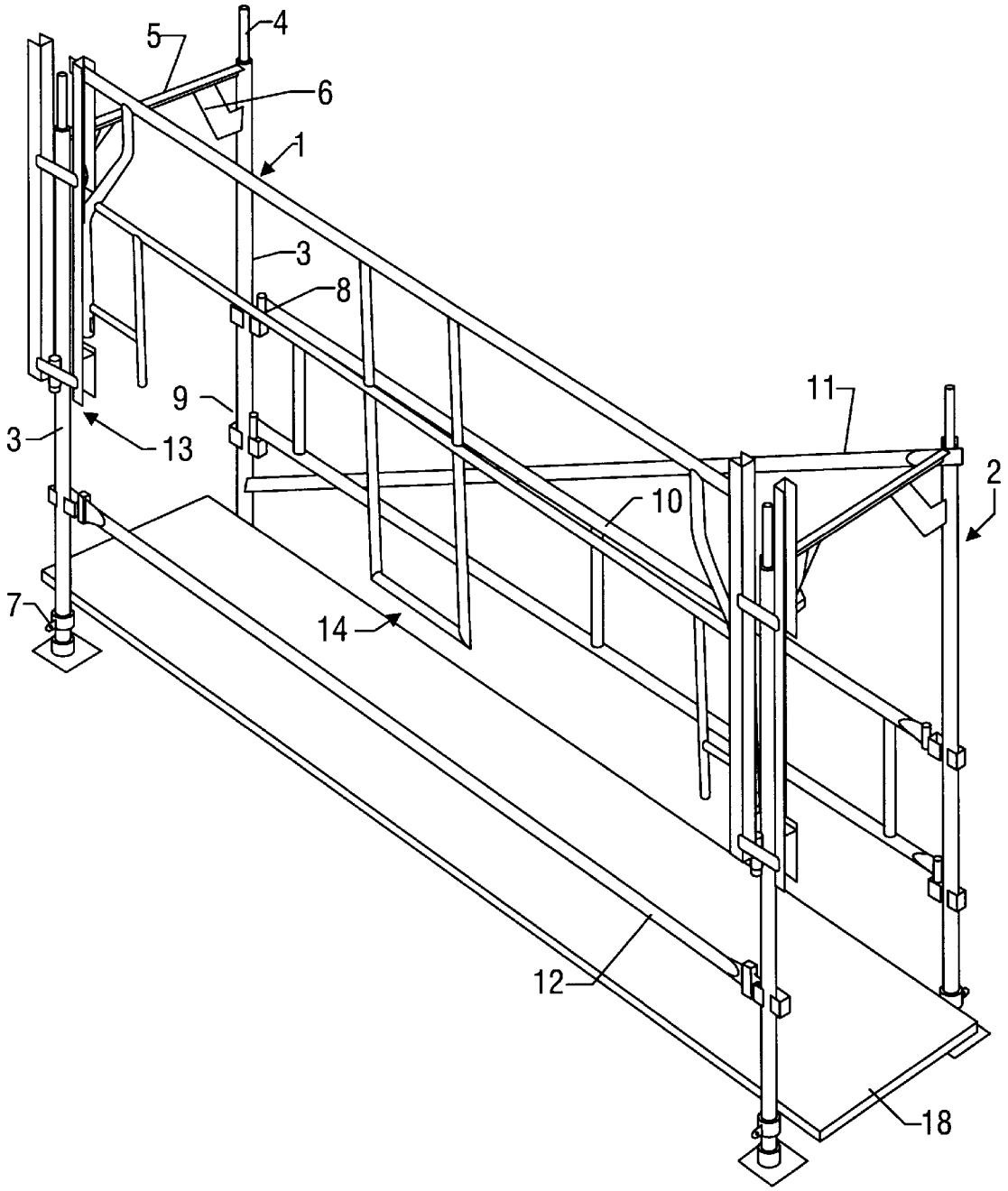
FIG. 3 is a view corresponding to FIGS. 1 and 2 showing the guard rail in a third position.
Figure 4:
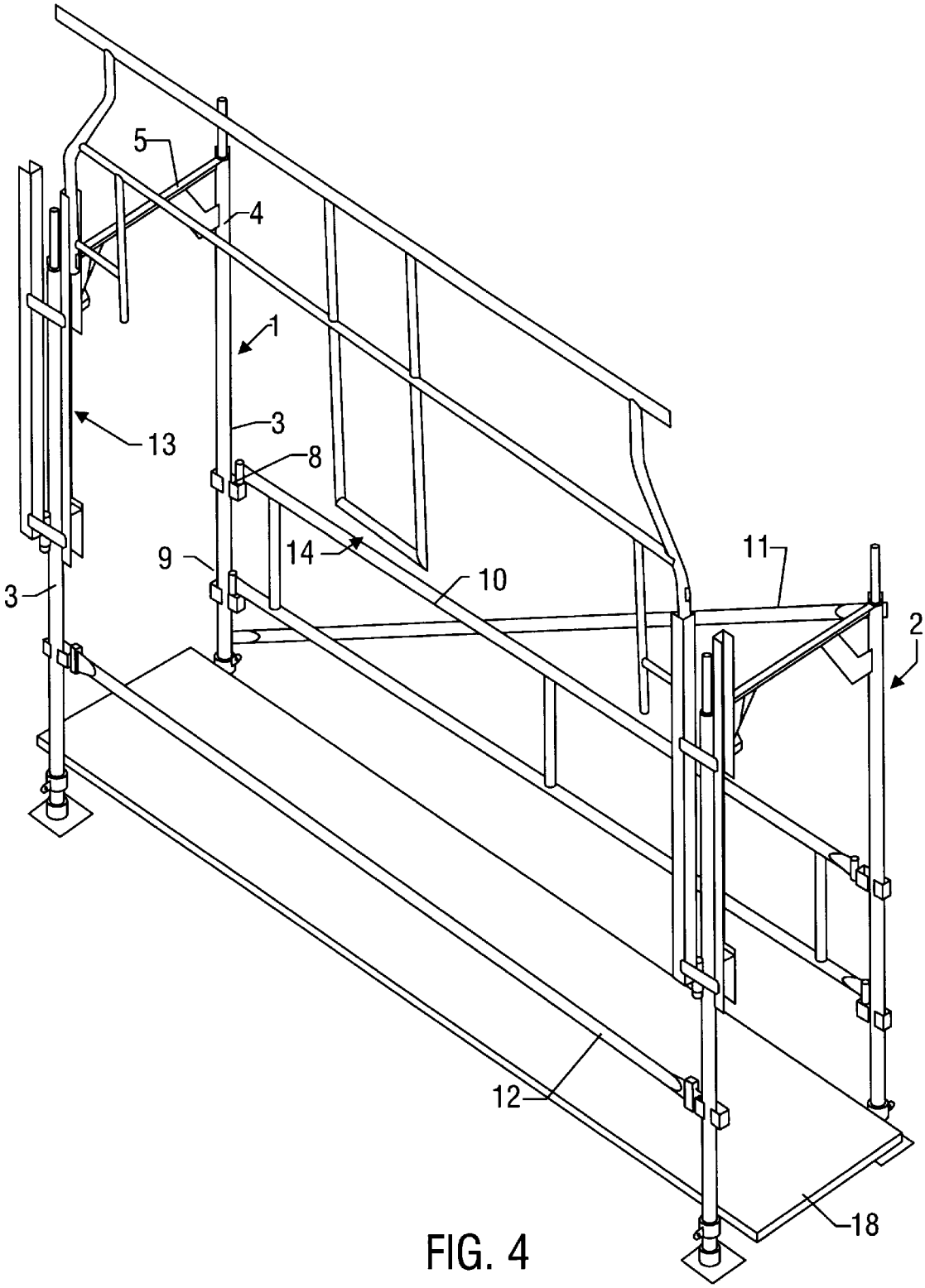
FIG. 4 is a view corresponding to FIGS. 1 to 3 showing the guard rail in a fourth position.

The guard rail 14 may subsequently be raised to a further elevated position as shown in FIG. 3. Again, the distance of the lift is not very great enabling the lift to be accomplished by one man. Finally, the guard rail 14 may again be lifted to a final position as shown in FIG. 4. Again the lift is not over a very great distance so the lift can be accomplished by one man. It is to be appreciated that when the guard rail 14 is in the position of FIG. 4, the guard rail 14 is located adjacent the position to be occupied by further frames and flooring to be located on top of the illustrated bay of the frame scaffolding system.

Referring to FIG. 5, the guiding and support assembly 13 is illustrated in greater detail.

The guiding and support assembly 13 comprises two vertically extending elongate members 20,21 which are held in spaced parallelism by two transversely extending plates 22,23 which are welded or otherwise secured to the vertical elements 20,21. The plates 22,23 are spaced apart vertically.

The lower part of each of the vertical members 20,21 comprises a channel section 24,25, each channel section opening outwardly away from the other vertical member. Each channel section 24,25 terminates at its upper end with a horizontal transversely extending plate 26,27, the plate being located just below the end of the channel section so that a lip 28,29 is defined adjacent each of the horizontal plates 26,27.

Each of the upright members 20,21, located immediately above the horizontal plates 26,27 is formed of a "L" section 30,31. These sections may be considered to be a continuation of the channel sections 24,25, but with one channel side wall being removed.

The upper portion of each of the upright members 20,21 is again of channel form 32,33, with the channels again facing away from each other. Towards the lower end of each of the channel portions 32,33 a toggle- catch 34 is provided. Each toggle-catch 34 comprises an element 35 which is pivotally supported 36 between two projections 37, the element 35 being associated with a slot formed in the wall of the channel 33 located between the two members 37. The toggle-catch 34 may be rotated between a position in which it is totally retracted from the channel, thus permitting an element to slide freely within the channel, and an alternate position in which it extends across the channel, preventing downward movement of an element within a channel. When in this position the toggle-catch 34 may be moved, in response to an item moving upwardly through the channel past the catch, to a retracted position in which the said item may move past the catch, the catch automatically returning to the position in which it extends across the channel when the item has moved upwardly past the catch.

The lower transverse plate 22, which inter-connects the elongate members 20,21 is provided with a first horizontally extending inwardly directed vertical plate 38 and a further horizontally extending inwardly directed vertical plate 39 which carries a vertically extending length of tube 40. The lower end of the tube 40 extends beneath the lower edge of the plate 39. The lower end of the tube 40 may, if desired, be provided with a roller, the periphery of the roller extending beyond the periphery of the tube 40, the roller rolling about a horizontal axis.

The upper transverse plate 23 which inter-connects the elongate members 20,21 is provided with a horizontally extending inwardly directed vertical plate 41 which engages a further transverse vertical plate 42. The plate 23 engages one side of the channels 32,33, and the plate 42 engages the other side of one of the channels 33. The plate 42 only extends just over half-way towards the other channel 32. The plate 42 has a vertical notch 43 formed in its underside adjacent its free end. The notch 43 is located substantially half-way between the two channels 32,33.

Figure 7:
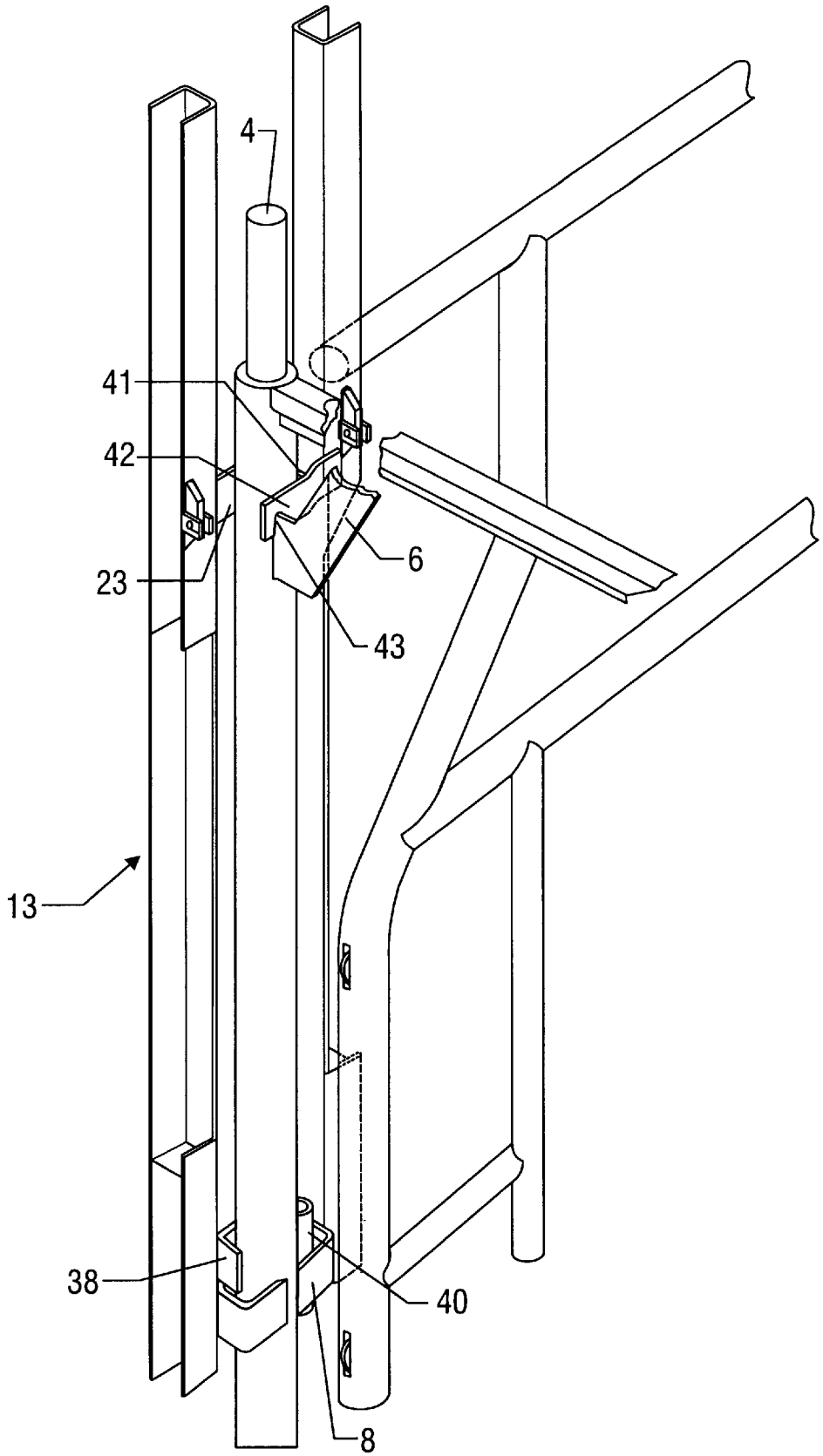
FIG. 7 is an enlarged view of part of the system when in the position illustrated in FIG. 2.

As can be seen most clearly from FIG. 7, the guiding and support assembly 13 may be mounted in position on an upright member 3 forming part of a frame by manipulating the guiding and support assembly 13 so that the tube 40 is inserted in one of the lugs 8 forming the upper pair of lugs, whilst the lower edge of the vertical plate 38 rests on top of the other lug 9. Thus the plate 38 provides support and the tube 40 provides location. Simultaneously the plate 42 is located so that the notch 43 receives part of the reinforcing plate 6 of the frame. Thus, the upper part of the guide and support element is also located.

The upper channel portions 32, 33 extend above the spigot 4 provided at the top of the upright member 3.

Figure 6:
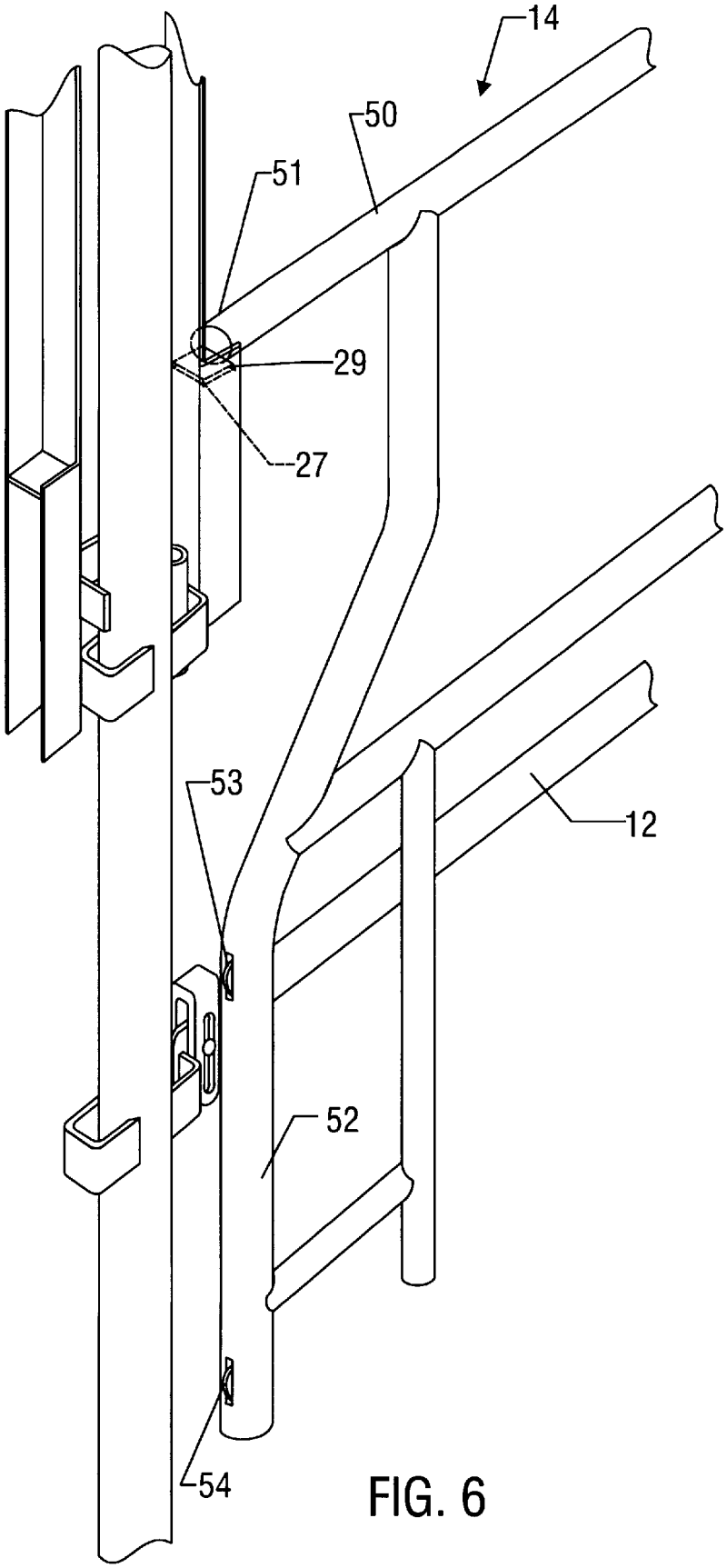
FIG. 6 is an enlarged view of part of the system when in the condition illustrated in FIG. 1.

As can be seen most clearly from FIG. 6, the guard rail 14 comprises an upper horizontal rail 50 having a protruding free end 51, the upper rail 50 being substantially horizontal. Located beneath the horizontal upper rail 50 is vertical side rail 52. Contained within the vertical side rail 52 are two rollers 53,54 having projecting portions to facilitate sliding of the guard rail 14 in a manner to be described below. The guard rail does have a lattice framework extending between the vertical side rail 52 and the horizontal top rail 50, but the design of this lattice framework is not critical to the operation of the invention.

As can be seen in FIG. 6, the free end 51 of the upper horizontal rail 50 is located on the plate 27 of the guiding and support element 13 and is retained in position by the lip 29. It is to be understood that the other end of the upper rail 50 will be located in a corresponding manner on a guiding and support element provided on the next frame.

The arrangement is thus as illustrated in FIG. 1. It is to be noted that the guard rail can effectively pivot about the free end 51 of the top rail 50, and the guard rail hangs down, resting against the horizontal bar 12.

Figure 2:
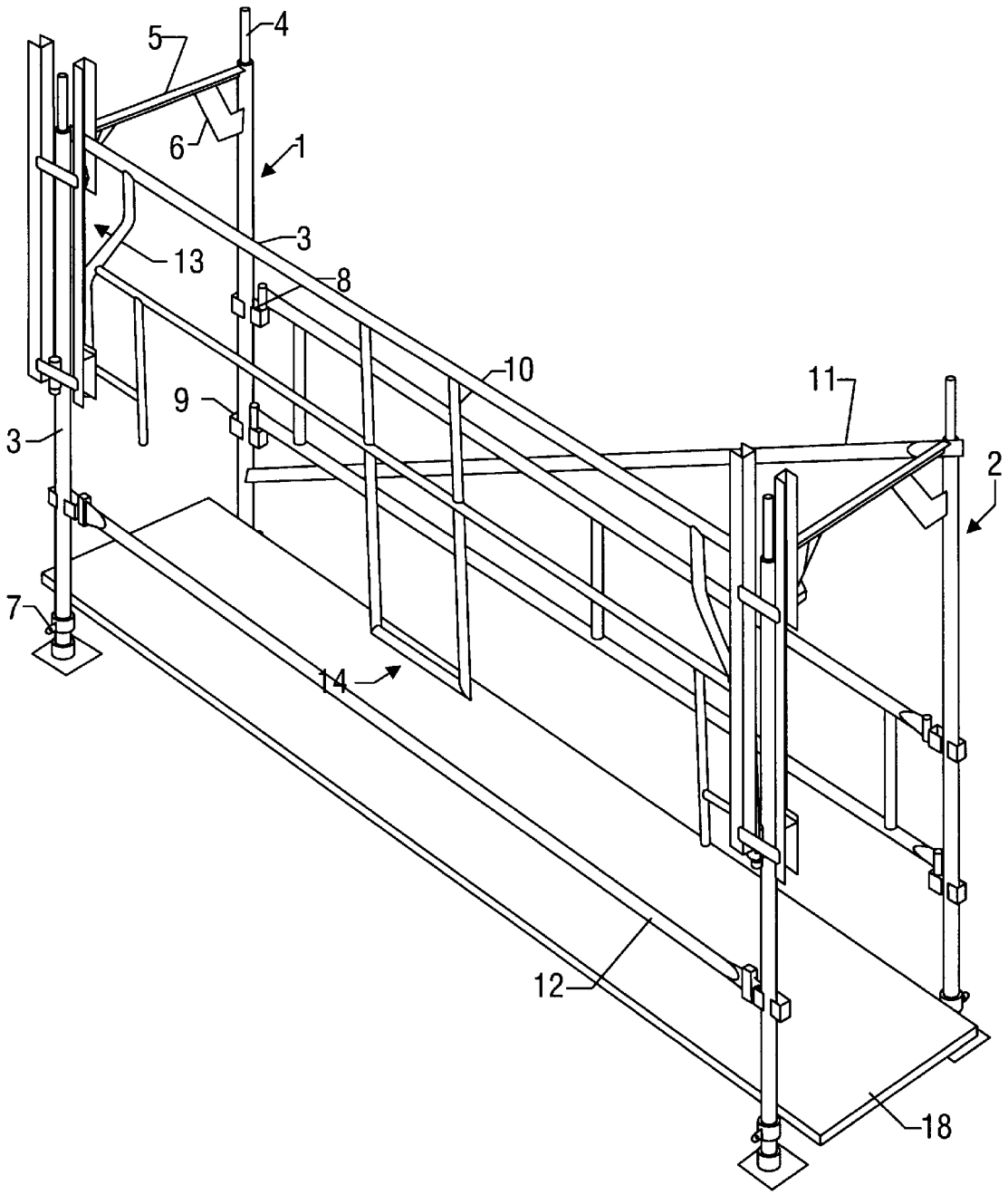
FIG. 2 is a view corresponding to FIG. 1 showing the guard rail in a second position.

The guard rail 14 may be lifted to the position illustrated in FIG. 2. This is accomplished by moving the latches 34 to a position in which the element 35 extends across the channel 33. The guard rail 14 is lifted and the free end 51 of the horizontal bar 50 is moved into the space beneath the channel 33 defined by the "L" section portion of the vertical member 21. The free end 51 of the guard rail 14 is then moved upwardly into the channel 33, past the latch member 34. The latch member permits this upward movement, retracting to let the free end 51 of the top rail pass, and then falling back into a position such that if the guard rail 14 is then lowered, the free end 51 of the top rail 50 will rest on the latch member 34 to thereby support the guard rail 14. As can be seen in FIG. 7, the vertical portion 52 is resting on the lip 29. This is the condition illustrated in FIG. 2.

Figure 8:
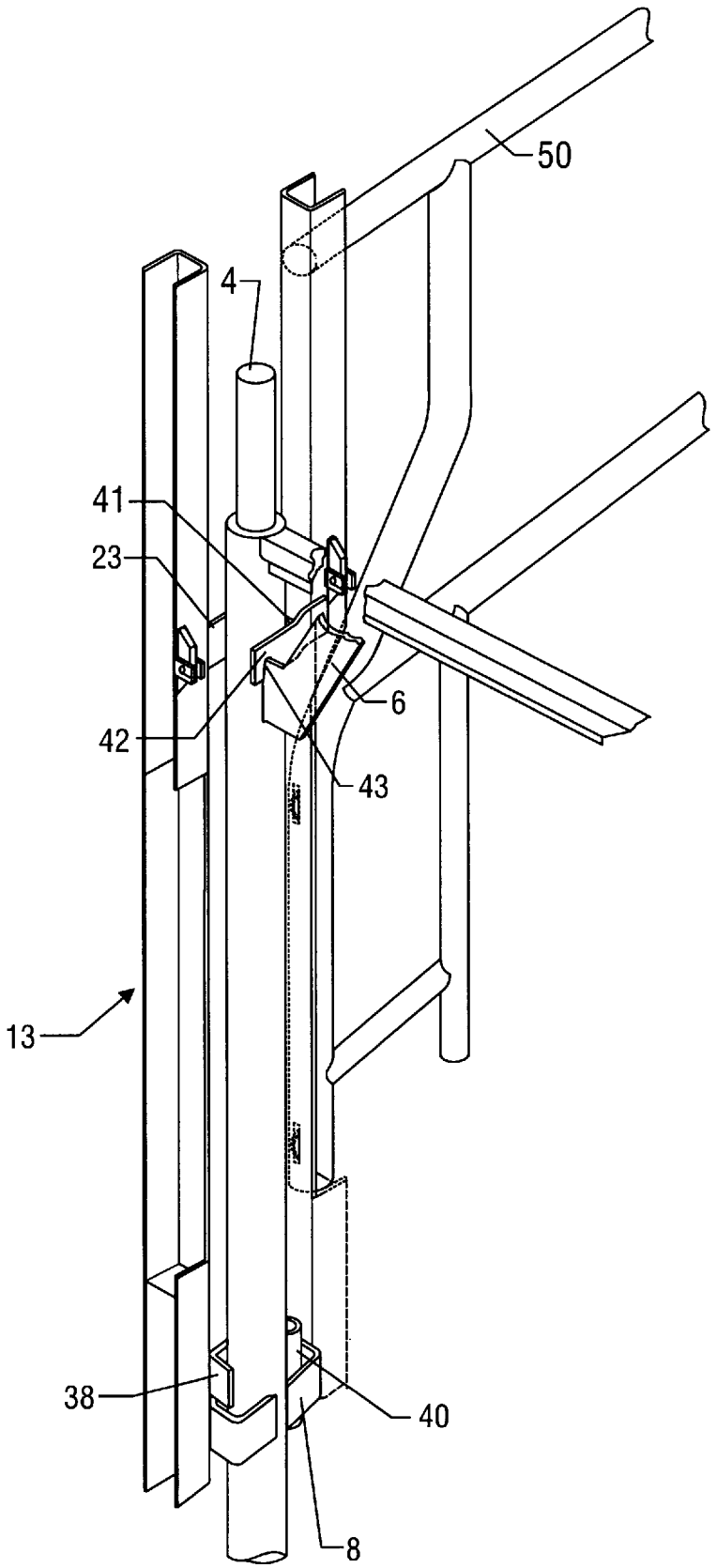
FIG. 8 is an enlarged view of part of the system when in the position illustrated in FIG. 3.

The guard rail 14 may be subsequently lifted further. The channel 33 will guide the movement of the free end 51 of the top rail 50, and the vertical tubular side portion 52 may be brought into abutment with the "L" sectioned portion 31 of the vertical member 21 and may subsequently be lowered so that the lower end of the tubular portion 52 rests on the platform 27 and is retained by the lip 29. It is to be appreciated that the tubular portion 52 is thus aligned with the channel 33, but is located beneath the channel 33. This is the condition illustrated in FIG. 3 and FIG. 8.

Figure 9:
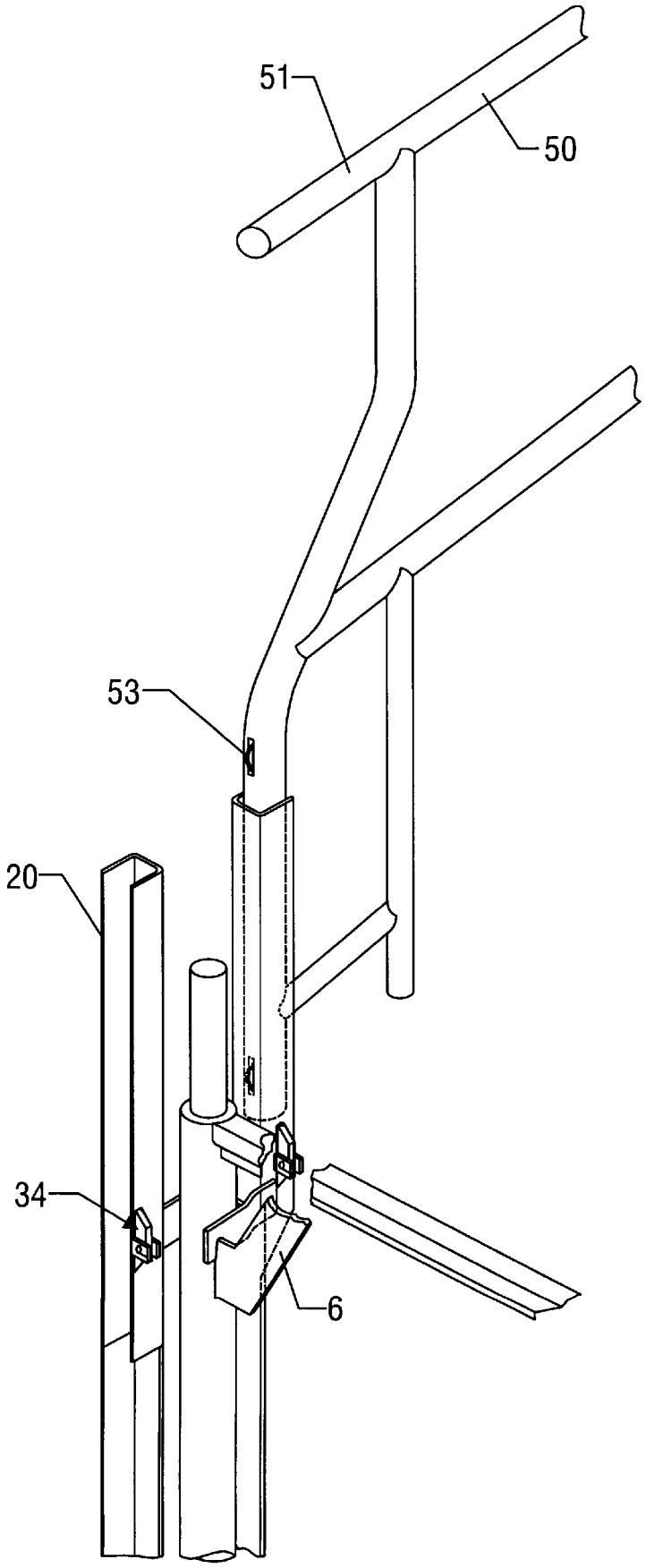
FIG. 9 is an enlarged view of part of the system when in the position shown in FIG. 4.

In the final movement of the guide rail 14, to the position illustrated in FIG. 4 and FIG. 9, the guide rail 14 is simply lifted. As the free end 51 of the top rail 50 leaves the top of the channel 33, so a portion of the vertical tubular element 52 enters the bottom of the channel 33. Thus, the upward movement is guided at all stages of the movement. The frame may be lifted to a position at which the lower-most end of the vertical tubular portion 52 is located above the catch 34. If the guard rail 14 is then lowered slightly, the lower end of the vertical tubular portion 52 will engage the catch 34, and the guard rail 14 will thus be retained in the elevated position illustrated in FIG. 9 and in FIG. 4.

It is to be appreciated that when the guard rail 14 is in this position, it is located adjacent the position to be occupied by the flooring and the frames of the next bay of the frame scaffolding system to be provided on top of the single bay of the frame system illustrated in FIGS. 1 to 4. The flooring of this next bay may rest on the cross bars 5 of the illustrated bay. The upright members 3 of the frames 1,2 of the next bay will engage the spigots 4 on the upper ends of the upright members 3 of the illustrated frames 1,2.

It is to be understood that when the frames for the bay above the illustrated bay have been placed in position, the channel sections 24,25 of the guiding and support assemblies 13 of the upper frames will engage the ends 51 of the upper rail 50 of the guard rail 14, thus providing additional lateral support.

It is to be understood that the next bay (i.e., the bay above the bay illustrated) will also be provided with a guard rail 14 as described and as illustrated, and this guard rail 14 may, in its turn, be lifted to a position in which it is located adjacent the next upper bay of the frame scaffolding system.

The scaffolding system may be de-mounted simply by reversing the procedures described above, meaning that the guide rail 14 may be left in position adjacent one level of the system, whilst that level is dis-assembled and removed, and subsequently the guard rail 14 may be lowered whilst working from a lower level.

Figure 10:
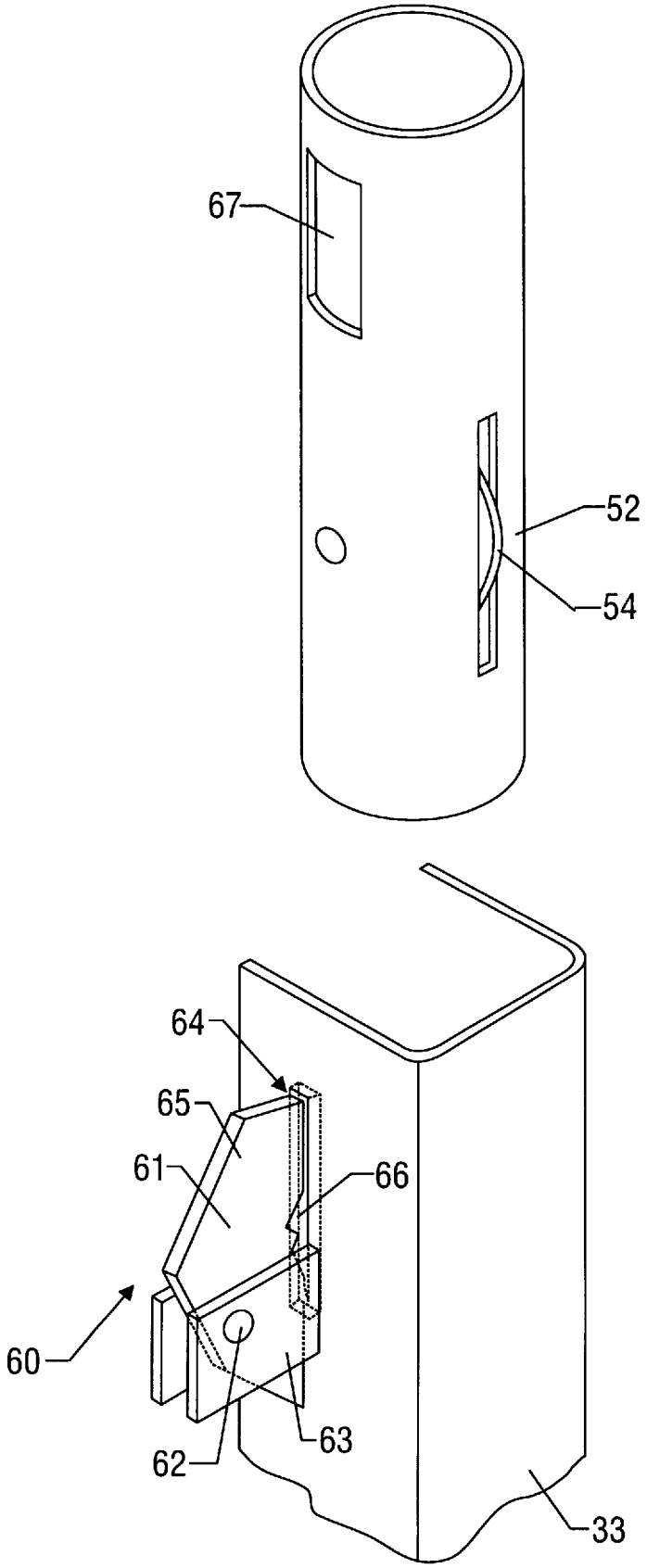
FIG. 10 is a view of a modified toggle catch, and a co-operating part of the guard rail.

FIG. 10 illustrates a modified catch 60 which corresponds and is intended to be substituted for the toggle catch 34 illustrated in FIG. 5.

The features of the toggle catch 60 are, in certain respects, similar to the features of the toggle catch 34.

The toggle catch 60 is intended to be mounted in position at the lower end of a channel portion, such as the channel portion 33. The toggle catch 60 comprises an element 61 which is pivotally supported 62 between two projections 63. The element 61 is associated with a slot 64 formed in the wall of the channel 33. The toggle catch element 61, has two operative surfaces. One is an outer surface 65 which, in the orientation of the toggle catch element 61 shown in FIG. 10, is an inclined surface, and the other operative part is a hook-like recess 66 formed on the opposite side of the toggle catch element 61.

The toggle catch 60 may be in a position in which the element 61 is totally retracted from the channel, thus permitting an element to slide freely within the channel, and an alternate position in which it extends across the channel. It is normally spring-biassed or gravity-biassed to the position in which it extends across the channel.

When the element 61 extends across the channel, it will provide support for the guard rail 14 when the guard rail 14 is above the toggle catch 60, and gravity is exerting a downward force on the guard rail 14.

However, it is to be noted that the guard rail 14, that is intended to co-operate with the illustrated catch 60, is modified in that the vertical side rail 52, in addition to having a roller 54 at its lower end is also provided with an aperture 67. The aperture 67 is located to be co-aligned with the toggle catch 60 when the guard rail 14 is lifted from the initial position.

It is to be appreciated that when the guard rail 14 is in the initial position, a portion of the vertical tubular element 52 adjacent the upper roller 53 will be adjacent the catch. Whilst the catch may be biassed, either by a spring or by gravity to the position in which it extends across the channel, the presence of the tubular portion 52 will prevent such inward movement. As the guard rail 14 is moved upwardly from the initial position, the catch 61 will slide along the surface of the tubular portion 52 until the catch 14 is aligned with the aperture 67. The catch element 61 will then rotate, and the hook-like recess 66 will engage the lower lip of the aperture 67, preventing the guard rail 14 from being moved further upwardly, unless a person is holding the catch element 61 manually in order to retain the catch element 61 in the position illustrated in FIG. 10. The person can only hold the catch 61 if the person is standing on the lower level of scaffolding, rather than being on the higher level of scaffolding. The provision of the catch arrangement illustrated in FIG. 10 will thus tend to prevent people who are utilising the scaffolding system from utilising it in an inappropriate manner, lifting the guard rail 14 from above, rather than raising the guard rail 14 from below.

Whilst the invention has been described with reference to specific embodiments, it is to be appreciated that modifications may be effected without departing from the scope of the invention. For example, whilst in the described embodiment the support and guide assembly 13 is a separate assembly which is releasably connected to the frames, the support and guide assembly 13 could be formed integrally with the frames. Whilst, in the described embodiments, means have been provided to enable the lift between the initial position and the final position to be accomplished in three separate stages, with three separate lifting operations, it is to be understood that in modified embodiments of the invention the lifting operation may be accomplished with a lesser number of lifting stages or, alternatively, with a greater number of lifting stages. Also, whilst the specifically described embodiment is a frame system, the invention may be embodied in a modular or other conventional scaffolding system.

What is claimed is:

1. A scaffolding system, comprising:

at least a pair of vertical members;

a guiding and support assembly coupled to said at least a pair of vertical members serving to guide and support a guard rail at least in an initial lowered position, an elevated terminal position, and at least one predetermined intermediate position between said initial position and said terminal position;

a guard rail comprising an upper rail having a first projecting free end and a second projecting free end, a lower rail a first generally vertical side rail located beneath said first projecting free end of said upper rail, and a second generally vertical side rail located beneath said second projecting free end of said upper rail, said guard rail being adapted, when in said elevated terminal position, to act as a guard rail for a level of scaffolding located above the level of scaffolding adjacent said initial lowered position; and each said guiding and support assembly comprising at least one elongate member coupled to one of said at least a pair of vertical members, said at least one elongate member defining a channel adapted to receive and guide at least one part of said guard rail, each said guiding and support assembly further defining a platform located in alignment with said channel in a position beneath said channel, said platform receiving and supporting at least one of said first and second projecting free ends of the upper rail in said lowered position, said platform supporting a lower end of one of said first and second generally vertical side rails of said guard rail in said intermediate position.

2. A scaffolding system for ensuring the safety of workers during assembly and disassembly, comprising:

(a) at least one pair of vertical members;

(b) a guiding and support assembly coupled to each of said at least one pair of vertical members having means for guiding and supporting a guard rail between at least an initial lowered position, an elevated terminal position, and at least one predetermined intermediate position between said initial lowered position and said elevated terminal position;

(c) a guard rail cooperating with said guiding and support assemblies, said guard rail including a generally horizontal upper rail having a first projecting free end and a second projecting free end, a generally horizontal lower rail, a first generally vertical side rail located beneath said first projecting free end of said upper rail, and a second generally vertical side rail located beneath said second projecting free end of said upper rail, said first and second vertical side rails each having a lower vertical portion and an upper angled portion, said lower vertical portions of said first and second side rails being coupled to said lower rail, said upper angled portions of said first and second side rails extending generally angularly inward toward each other between said lower vertical portions and said first and second projecting free ends, respectively, whereby said lower vertical portions of said first and second side rails slideably engage with said guiding and supporting assemblies and said upper angled portions of said first and second side rails do not engage with said guiding and supporting assemblies to minimize the engagement surface therebetween and thereby facilitate the movement of said guard rail between said initial lower position, said elevated terminal position, and said at least one predetermined intermediate position, said guard rail being adapted, when in said elevated terminal position, to act as a guard rail for a level of scaffolding located above the level of scaffolding adjacent said initial lowered position, said first and second free protecting ends of said upper rail engaging said means for supporting and guiding when said guard rail is disposed in said lowered position.

* * * * *

UNITED STATES PATENT AND TRADEMARK OFFICE

CERTIFICATE OF CORRECTION

| | | |
|---|---|---|
| PATENT NO. | : | 5,829,550 |
| DATED | : | November 3, 1998 |
| INVENTOR(S) | : | John Robert E. Cornish |

It is certified that error appears in the above-identified patent and that said Letters Patent is hereby corrected as shown below:

In column 3, line 30, please delete "8" and replace with --18-- therefor.

In column 5, line 39, between 'member' and 'permits', please insert --34-- therefor.

In column 7, line 3, please delete "14" and insert --61-- therefor.

Signed and Sealed this

Thirtieth Day of March, 1999

*Attest:*

*Attesting Officer*

Q. TODD DICKINSON

*Acting Commissioner of Patents and Trademarks*